United States Patent [19]

Dietch

[11] 3,952,225

[45] Apr. 20, 1976

[54] CATHODE-RAY TUBE HAVING PHOSPHOR SCREEN INTERPOSED BETWEEN COMPOSITE MESH AND REFLECTIVE LAYER

[75] Inventor: Leonard Dietch, Skokie, Ill.

[73] Assignee: Zenith Radio Corporation, Chicago, Ill.

[22] Filed: Oct. 18, 1971

[21] Appl. No.: 190,013

Related U.S. Application Data

[63] Continuation-in-part of Ser. No. 13,564, Feb. 24, 1970, Pat. No. 3,614,503.

[52] U.S. Cl. ..... 313/472; 313/473; 313/408

[51] Int. Cl.[2] ..... H01J 29/28; H01J 29/30; H01J 29/32

[58] Field of Search ..... 313/92 B, 92 PD, 112, 313/110 US, 110 X, 92 BI

[56] References Cited

UNITED STATES PATENTS

| | | | |
|---|---|---|---|
| 2,842,697 | 7/1958 | Bingley | 313/92 BI |
| 3,362,804 | 1/1968 | Hamilton | 313/110 X |
| 3,569,761 | 3/1971 | Lange | 313/92 B |
| 3,614,504 | 10/1971 | Kaplan | 313/92 B |

*Primary Examiner*—Robert Segal
*Attorney, Agent, or Firm*—John J. Pederson

[57] ABSTRACT

An image screen structure for a monochrome or a color cathode-ray tube, in which the phosphor screen is interposed between a composite mesh and the conventional reflective metal backing layer. The composite mesh comprises a reflective grille and a non-reflective grille in registration with the reflective grille. The reflective grille faces the phosphor screen so that light generated by phosphor excitation behind the non-reflective grille finds egress by multiple reflections between the reflective grille and the metal backing layer. In a color cathode-ray tube such as a tri-color shadow-mask television picture tube, the non-reflective and reflective grilles may be non-coherent with the mosaic phosphor screen, thus avoiding the necessity of complicated and costly processing which has been employed in the manufacture of black-surround color picture tubes. A substantial improvement in brightness/contrast performance is obtained as compared with the best prior art monochrome and color cathode-ray tubes.

17 Claims, 8 Drawing Figures

FIG. 4
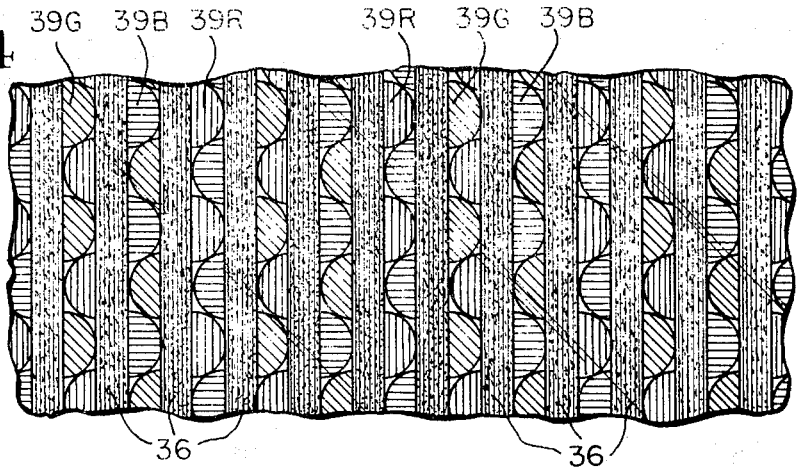
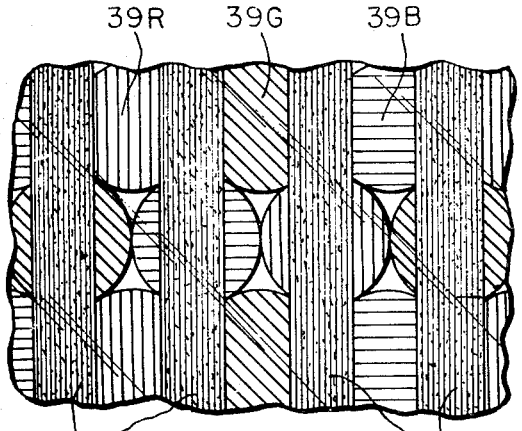
FIG. 4a
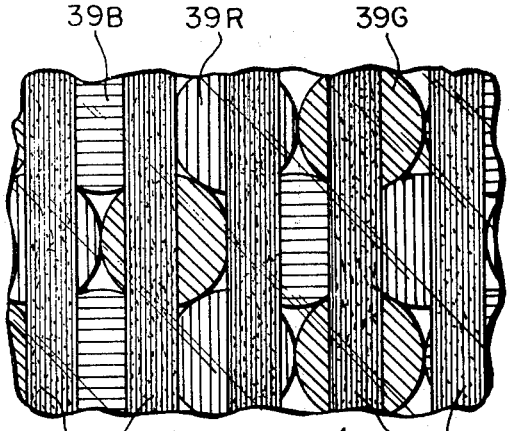
FIG. 4b
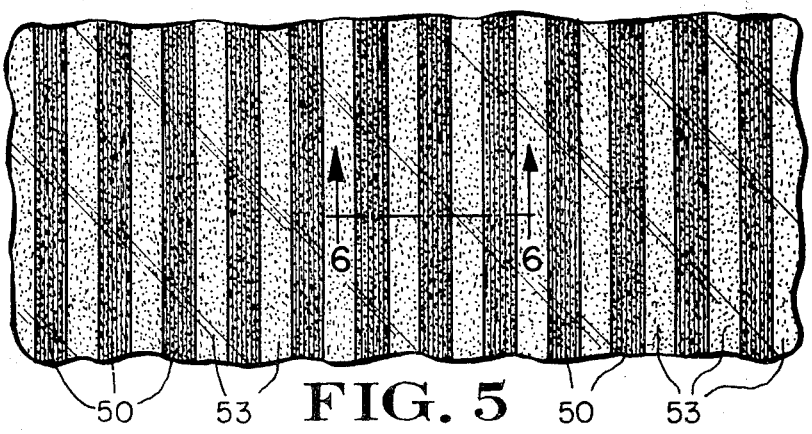
FIG. 5
FIG. 6
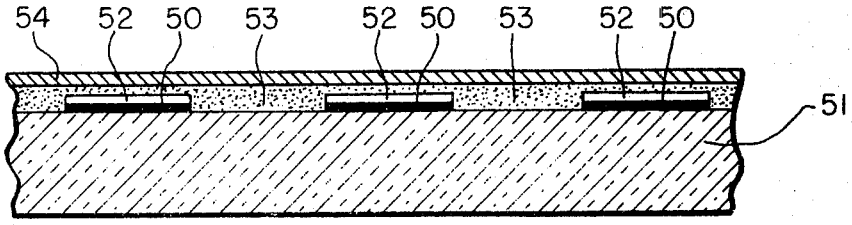

CATHODE-RAY TUBE HAVING PHOSPHOR SCREEN INTERPOSED BETWEEN COMPOSITE MESH AND REFLECTIVE LAYER

RELATED APPLICATION

This application is a continuation-in-part of application Ser. No. 13,564, filed Feb. 24, 1970, by the present applicant for "IMPROVED BLACK-SURROUND COLOR PICTURE TUBE", new U.S. Pat. No. 3,614,503 which application is assigned to the same assignee as the present application.

BACKGROUND OF THE INVENTION

This invention is directed to the improvement of brightness and contrast in monochrome and color cathode-ray tubes such as television picture tubes.

In the present state of the color television picture tube art, premium tubes for maximum brightness and optimum contrast are of the black-surround variety, in which the interleaved deposits of different phosphor materials are surrounded with a non-reflective or light-absorbing material which is usually colloidal graphite or some other black material. The provision of such a non-reflective grille surrounding the individual phosphor deposits reduces ambient light reflection from the front face of the picture tube in its operating environment and thus dramatically reduces contrast dilution from ambient light. This in turn permits the use of a clear glass or high-transmission filter faceplate which in turn transmits a greater amount of light generated at the phosphor screen and results in greatly enhanced picture brightness. Such a tube is described and claimed for example in U.S. Pat. No. 3,146,368 granted Aug. 25, 1964, to Joseph P. Fiore et al. and assigned to the same assignee as the present application.

Still further brightness increase and contrast improvement can be obtained as disclosed and claimed in the above-identified copending Dietch application, by providing a reflecting layer between the phosphor dots and the black-surround grille; this, together with the conventional metal backing layer, permits light generated behind the black-surround grille to find egress and contribute to picture brightness rather than being absorbed in the black-surround material.

To manufacture a color picture tube of the reverse-tolerance black-surround type shown and described in the above-identified Fiore et al patent, it is required that the grille of black-surround material be formed with interstices which are smaller than the holes of the associated shadow mask. Various processing techniques have been employed to achieve this objective, either by temporarily closing down the shadow mask apertures prior to photographic exposure of the screen forming resist or by initially forming the shadow mask with small apertures and later re-etching to enlarge the apertures after the black-surround grille and the phosphor screen have been formed. Such processing complications are obviously costly and difficult to practice on a mass-production basis.

It is a principal object of the present invention to provide a new and improved cathode-ray tube image screen.

A more particular object of the invention is to provide a new and improved image screen for a color cathode-ray tube which exhibits brightness/contrast performance comparable to or superior to even the best black-surround color television picture tubes.

A further and extremely important object of the invention is to provide such a new and improved cathode-ray tube image screen which can be manufactured without the use of complicated processing techniques such as temporary hole closure or re-etching of the shadow mask apertures.

Yet another object of the invention is to provide a new and improved image screen structure for cathode-ray tubes which is useful to provide greatly improved brightness/contrast performance from a monochrome or black-and-white cathode-ray tube.

SUMMARY OF THE INVENTION

The invention provides a high-brightness, high-contrast cathode-ray tube image screen comprising a transparent faceplate. A substantially non-reflective grille is provided on the faceplate and a reflective grille is provided in registration with the non-reflective grille. A phosphor screen is provided on the faceplate over the reflective grille, and a reflective backing layer is applied over the phosphor screen.

BRIEF DESCRIPTION OF THE DRAWINGS

The features of the present invention which are believed to be novel are set forth with particularity in the appended claims. The invention, together with further objects and advantages thereof, may best be understood by reference to the following description taken in connection with the accompanying drawings, in the several figures of which like reference numerals identify like elements, and in which:

FIG. 4 is a fragmentary front view, looking through the front face of the picture tube or from below the plane of the drawing of FIG. 2, at the image screen of FIG. 2;

FIGS. **4*a* and 4*b* are enlarged fragmentary and idealized views similar to that of FIG. 4**, showing different size and position relationships between the grille and the phosphor screen;

FIG. 5 is a fragmentary front plan view through the faceplate of a monochrome television picture tube embodying the invention; and FIG. 6 is a fragmentary cross-sectional view along the line 6—6 of FIG. 5.

DESCRIPTION OF THE PREFERRED EMBODIMENTS

Figure 1:
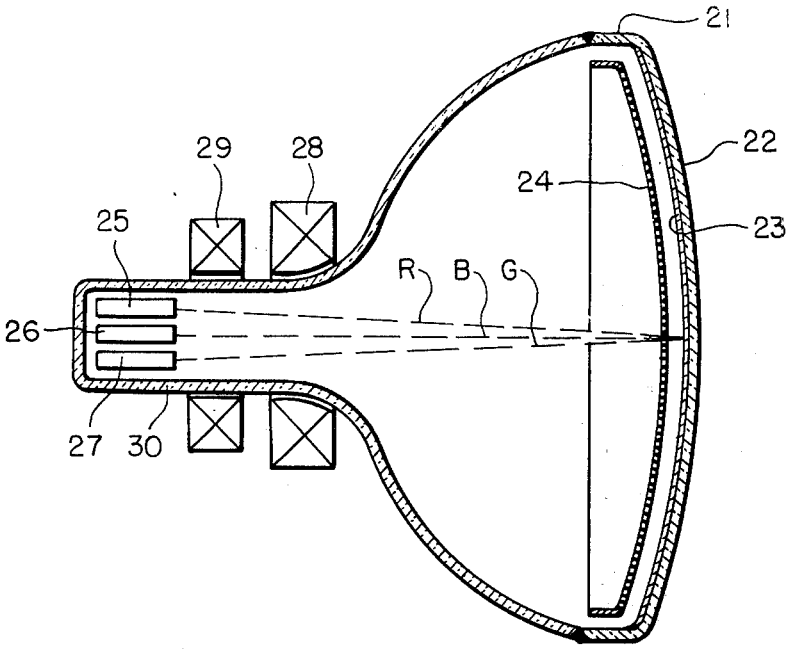
FIG. 1 is a cross-sectional view, partly schematic, of a tri-color television picture tube of the shadow mask variety.

FIG. 1 represents the basic elements of a shadow mask type of tri-color television picture tube. The envelope 21 includes a faceplate section 22 which is transparent and usually made of glass, on the inner surface of which is deposited a tri-color phosphor screen with an aluminum or other reflective backing layer. In proximity to the tri-color mosaic screen and spaced therefrom is an apertured shadow mask 24, each aperture of which is in registration with a triad of red-emissive, blue-emissive and green-emissive phosphor dots.

In the neck of the envelope are three electron guns 25, 26 and 27, shown in alignment but which may be and indeed usually are arranged in the neck in a triangular or delta array. The electron beams R, B and G from guns 25, 26 and 27 respectively approach shadow mask 24 from different angles and thus are selectively directed to the red-emissive, blue-emissive and green-emissive phosphor areas on screen 23. A deflection yoke 28 and a convergence yoke 29 encompass the neck section 30 of the envelope and are responsive to appropriate energizing signals from a television receiver chassis (not shown) to effect raster scanning of the image screen and to maintain convergence of the three electron beams R, B and G at all points in the image raster. All of this is well-known in the art and provided here merely for the purpose of establishing appropriate structural and terminological references for use in the ensuing description of the invention.

Figure 2:
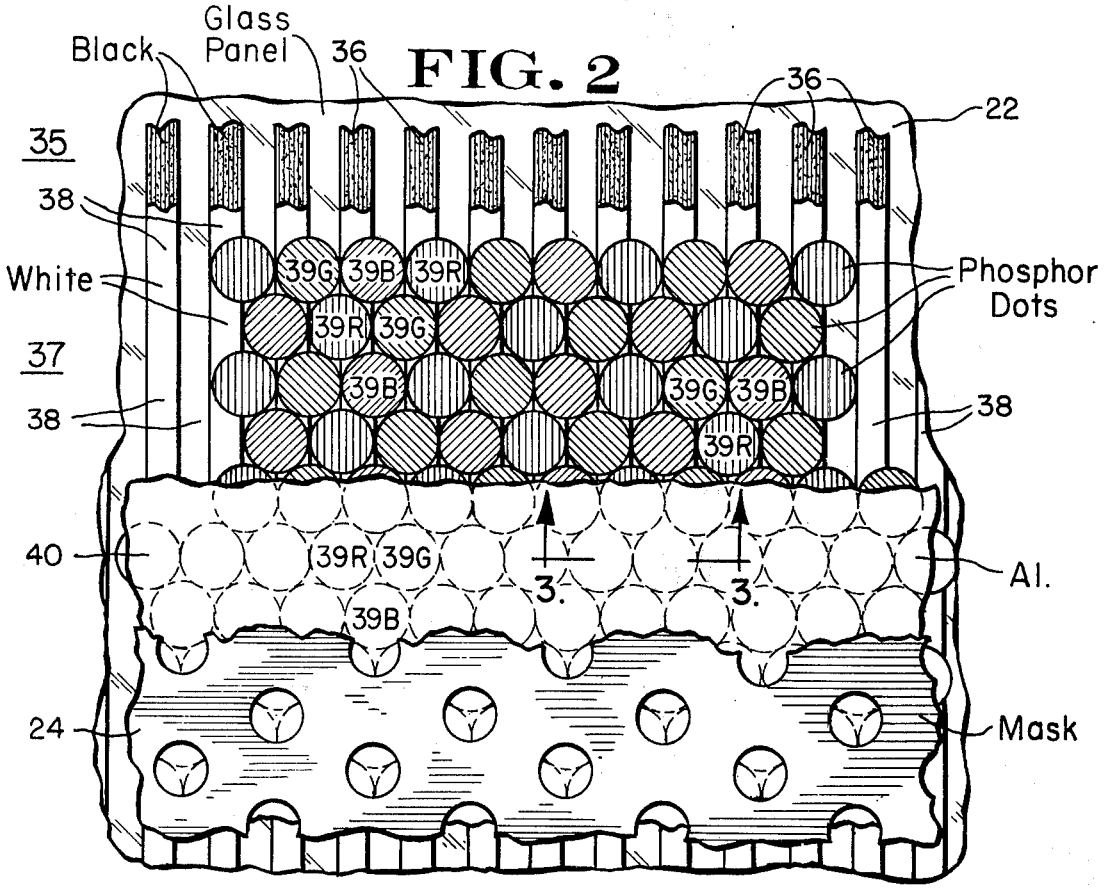
FIG. 2 is a fragmentary plan view, partly cut away, of the shadow mask and image screen section of a color television picture tube, of the type shown in FIG. 1, embodying the present invention.

FIG. 2 shows the image screen of a tri-color television picture tube constructed in accordance with the present invention, viewed from the inner surface or the shadow mask side of the image screen. The inner surface of the glass faceplate 22 is provided with an adherent non-reflective or light-absorbing grille 35 composed of parallel black strips 36. Superposed over the non-reflective grille 35 is an adherent reflective grille 37 which is composed of individual parallel strips of reflective material 38. The reflective grille 37 may be either diffusely reflective, in which case it may be formed of an opaque white material such as a white pigment, or it may be specularly reflective as by being of metallic composition such as aluminum.

Overlying the composite mesh composed of non-reflective grille 35 and reflective grille 37 is a conventional tri-color phosphor dot screen which may be formed of tangent round phosphor elements or dots 39R, 39B and 39G of red-emissive, blue-emissive and green-emissive phosphor materials respectively. The phosphor screen 39R, 39B, 39G is in turn provided with the conventional metal backing layer 40 which is usually formed of aluminum. The shadow mask 24, spaced in front of the composite image screen as shown in FIG. 1, may be of an entirely conventional construction with apertures of a size-and-distribution pattern employed in conventional non-black-surround types of tri-color dot screen shadow mask television picture tubes.

Figure 3:
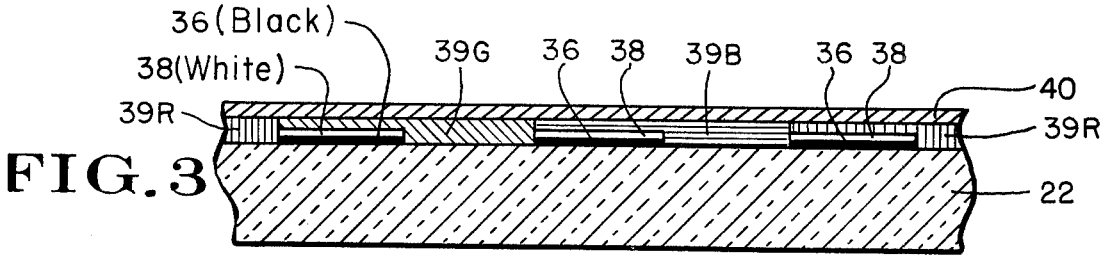
FIG. 3 is a fragmentary cross-sectional view taken along the line 3—3 of FIG. 2.

The manner in which the composite grille construction of the present invention achieves substantial improvement in brightness/ contrast performance of the image screen may be appreciated from a consideration of the cross-sectional fragmentary view of FIG. 3. Light emitted in the open phosphor areas finds its way out directly through the faceplate. However, light emitted from excited phosphor areas behind the black grille (as seen from the viewing side), instead of being dissipated by light absorption in the black grille, is subjected to multiple reflection between the white grille elements 38 and the aluminum backing layer 41 until it finally reaches the open phosphor areas whereupon this additional light is also emitted through the faceplate. It may be observed that multiple reflections may lead to light emission of one color through open phosphor areas having a different direct-excitation color response, but the phosphor areas are so small and close together that no noticeable picture degradation is discernible due to this cause.

The particular configuration of the non-reflective grille and its superposed reflective backing grille is not critical to the achievement of the objectives of the invention, so long as the open areas of the grille work are sized and distributed to permit light egress from each phosphor element. This may be conveniently accomplished by making the grilles of parallel strips with the individual strip widths and the interstrip spacings being small relative to the phosphor dot diameters. To avoid moire patterns in the reproduced image if a strip configuration is employed, the strips are oriented transversely to the line-scanning or horizontal direction; thus they are vertically oriented in the illustrated embodiment.

The light transmission factor of the grille, that is the ratio of its open area to total screen area, may be from 30% to 80% with optimum results when the light transmission factor is approximately 50%. In the illustrated embodiment, the widths of the individual strips 36 are equal to the spacings between adjacent strips. The relative dimensions may be readily visualized from the view of FIG. 4, which is a front view, through the glass faceplate from the viewing side, showing that portions of each of the phosphor dot elements 39R, 39G and 39B are exposed to view through the open areas between the vertically oriented black grille strips 36. In this particular figure, the strip widths and the interstrip spacings of the grille are each equal to one-half a phosphor dot diameter, and the edges of each grille strip are tangent to the phosphor dots of a particular emission color.

To achieve the benefits of the invention, the lateral orientation of the grille with respect to the phosphor dots is of no consequence; no particular alignment need be maintained between grille and phosphor screen. In FIG. 4*a*, for example, the grille strips 36 are centrally oriented with respect to phosphor dots of a selected emission color. Lateral positioning of the vertically oriented grille strips relative to the phosphor dots may be varied or selected as desired or at random without affecting the performance of the tube. Also, as shown in FIG. 4*b*, the pitch of the grille, i.e., the spacing between adjacent black elements 36, may be non-integrally related to the phosphor dot dimensions. In other words, the grille positioning relative to the phosphor dot pattern is arbitrary and may be varied as desired, except for such considerations as moire elimination, and in any event a grille pattern which is non-coherent with the phosphor dot pattern may be employed, thus eliminating the necessity for costly and difficult processing techniques such as shadow mask hole closure or re-etching.

The composite grille with its reflective and non-reflective components may be formed directly on the inner surface of the glass faceplate by conventional photo-resist processes analogous to those employed in the manufacture of black-surround color picture tubes except for the use of a non-critically oriented optical mask and a bright open light source instead of exposing from point sources through a shadow mask. Other known processes such as electrophoretic deposition, for example, may be employed to deposit a white pigment such as titanium dioxide on predeposited black elements of colloidal graphite or the like. The use of transfer processes, decalcomania, or the like may also be visualized.

The invention may also be employed to achieve greatly enhanced brightness/contrast performance from a monochrome television picture tube. As shown in FIGS. 5 and 6, a composite grille formed of black or light-absorbing strip elements 50 are provided on the inner surface of the glass faceplate 51 of a conventional monochrome picture tube. Black grille strips 50 are backed by reflective grille strips 52 which again may be either a white opaque material having a high index of refraction, such as titanium dioxide, or a specularly reflective metal backing strip of aluminum of the like. Over the non-reflective and reflective grilles 50 and 52 is deposited a uniform monochrome phosphor screen 53 and this is overlaid by an aluminum backing layer 54, in the usual manner. Again, the light transmission factor of the nonreflective and reflective grilles is advantageously in the range from 30 to 80% and optimally approximately 50%. In operation, the light absorbing or non-reflective grille elements 50 absorb ambient room lighting to enhance the contrast of the reproduced image, while light emitted from phosphor areas behind the reflective grille strips 52 is subjected to multiple reflection between grille strips 52 and aluminum backing strips 54 until it finds egress in the interstrip regions to enhance image brightness. Again there is no critical configuration or orientation of the grille pattern, but if a strip pattern is used vertical orientation is desirable to avoid undesirable moire and related effects.

Thus the invention provides a new and greatly improved high-brightness, high-contrast cathode-ray tube image screen construction for use in either monochrome or color picture tube environments. Use of constructions in accordance with the invention permits great processing simplification, particularly in the manufacture of premium-type color television picture tubes with brightness/contrast performance equivalent or superior to that of the best prior art black-surround picture tubes.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A high-brightness, high-contrast cathode-ray tube image screen comprising:

a transparent faceplate;

on said faceplate, a grille composed of a material which is substantially non-reflective to light entering the front of the image screen through said faceplate;

a reflective grille supported on said faceplate behind and in substantial registration with said non-reflective grille;

a phosphor screen on said faceplate over said reflective grille; and a reflective backing layer on said phosphor screen.

2. A cathode-ray tube image screen according to claim 1, in which said phosphor screen is a uniform layer of monochrome phosphor.

3. A cathode-ray tube image screen according to claim 1, in which said phosphor screen is a tri-color screen comprising interleaved deposits of phosphor materials which emit light of different colors.

4. A cathode-ray tube image screen according to claim 1, in which said superposed non-reflective and reflective grilles exhibit a light transmission factor of from 30 to 80%.

5. A cathode-ray tube image screen according to claim 4, in which said non-reflective and reflective grilles present a light transmission factor of approximately 50%.

6. A cathode-ray tube image screen according to claim 1, in which said non-reflective grille is black and said reflective grille is white and opaque.

7. A cathode-ray tube image screen according to claim 6, in which said reflective grille is composed of a white pigment.

8. A cathode-ray tube image screen according to claim 1, in which said non-reflective grille is black and said reflective grille is metallic.

9. A cathode-ray tube image screen according to claim 1, in which said non-reflective and reflective grilles are formed of substantially parallel strips extending transversely with respect to the line-scanning direction.

10. A cathode-ray tube image screen according to claim 3, in which said phosphor screen is a tri-color dot screen comprising regularly interspersed dots of red-emissive, blue-emissive and green-emissive phosphor materials, and in which said grilles are constructed and porportioned to present openings in registration with a portion of each of the individual phosphor dots.

11. A cathode-ray tube image screen according to claim 3, in which said phosphor screen is a tri-color dot screen comprising regularly interspersed dots of red-emissive, blue-emissive and green-emissive phosphor materials and in which said non-reflective grille comprises substantially parallel black strips with the individual strip widths and the interstrip spacings being small relative to the individual phosphor dot diameters.

12. A cathode-ray tube image screen according to claim 11, in which said parallel strips extend transversely with respect to the line-scanning direction of said image screen.

13. A cathode-ray tube image screen according to claim 10, in which said non-reflective and reflective grilles present a light transmission factor of approximately 50%.

14. A cathode-ray tube image screen according to claim 3, in which said non-reflective and reflective grilles are non-coherent relative to the interleaved deposits of phosphor materials.

15. A color television picture tube comprising:

a glass faceplate;

non-reflective and reflective grille coatings on said faceplate in registration with each other with the non-reflective grille presented to the outer viewing surface and the reflective grille presented to the inner surface of the faceplate;

a tri-color phosphor screen comprising interspersed elements of different phosphor materials having respectively different color-emission characteristics and deposited on said inner surface of said faceplate over said reflective grille with a portion of each phosphor element in registration with a grille opening;

a metal backing layer for said phosphor screen;

and means including an electron gun assembly and a color-selection electrode between said electron gun assembly and said phosphor screen in proximity with the phosphor screen for selectively exciting phosphor elements of the respective different color-emission characteristics, whereby light developed by phosphor excitation behind said grilles is subjected to multiple reflection between said reflective grille and said metal backing layer until transmitted laterally to an opening in said grilles.

16. A monochrome television picture tube comprising:

an envelope having a glass viewing panel;

reflective and non-reflective grille coatings on said viewing panel in registration with each other, with the non-reflective coating being presented outwardly and the reflective coating inwardly of said viewing panel;

a phosphor screen coating on the inner surface of said viewing panel over said reflective grille;

a metal backing layer for said phosphor screen;

and means including an electron gun for exciting said phosphor screen, whereby light developed in phosphor areas behind said grilles is transmitted laterally by multiple reflection between said reflective grille and said metal backing layer to contribute to picture brightness by emission outwardly through open areas in said grilles.

17. A high-brightness, high-contrast cathode-ray tube image screen comprising:

a transparent faceplate;

on the back of said faceplate, a layer of material which is substantially non-reflective to light entering the front of the image screen through said faceplate and which is configured to have a predetermined pattern of light-transmissive openings;

a layer of light-reflective material supported on said faceplate behind said non-reflective layer and having a pattern of openings similar to said predetermined pattern and in substantial registration therewith;

a phosphor screen on said faceplate disposed over said registered openings in said non-reflective and reflective layers and in areas adjacent said openings;

and a light-reflective backing layer on said phosphor screen, whereby light emitted by said phosphor screen in said areas adjacent said openings which might otherwise be blocked by said non-reflective layer is conducted laterally to said openings by multiple reflection between said reflective layer and said backing layer.

* * * * *